United States Patent [19]

Reinhardt

[11] 4,248,593

[45] Feb. 3, 1981

[54] PROCESS FOR OBTAINING FAST COLORATIONS AND PRINTS ON MATERIALS CONSISTING OF CELLULOSIC FIBERS OR OF BLENDS THEREOF WITH SYNTHETIC FIBERS

[75] Inventor: Friedrich Reinhardt, Bad Soden am Taunus, Fed. Rep. of Germany

[73] Assignee: Hoechst Aktiengesellschaft, Frankfurt, Fed. Rep. of Germany

[21] Appl. No.: 932,617

[22] Filed: Aug. 10, 1978

[30] Foreign Application Priority Data

Aug. 13, 1977 [DE] Fed. Rep. of Germany ..... 2736563

[51] Int. Cl.[3] ..... D06P 3/84; D06P 3/58

[52] U.S. Cl. ..... 8/532; 8/529; 8/531; 8/636

[58] Field of Search ..... 8/21 C, 82, 174, 54.2

[56] References Cited

U.S. PATENT DOCUMENTS

| | | | |
|---|---|---|---|
| 2,785,040 | 3/1957 | Gross et al. | 8/82 |
| 3,418,063 | 12/1968 | Ulrich et al. | 8/54.2 |
| 3,494,716 | 2/1970 | Hoffman | 8/21 C |
| 3,545,910 | 12/1970 | Ongi | 8/21 C |
| 3,649,161 | 3/1972 | Von der Eltz et al. | 8/82 |
| 3,807,945 | 4/1974 | Von der Eltz et al. | 8/21 C |
| 3,888,624 | 6/1975 | Blackwell et al. | 8/54.2 |
| 3,990,839 | 11/1976 | Von der Eltz et al. | 8/21 C |
| 3,993,438 | 11/1976 | Fishwick, et al. | 8/21 C |
| 4,023,925 | 5/1977 | Jack et al. | 8/21 C |

FOREIGN PATENT DOCUMENTS

| | | | |
|---|---|---|---|
| 998207 | 10/1976 | Canada . | |
| 1469750 | 12/1973 | Fed. Rep. of Germany | 8/21 C |
| 2443268 | 3/1975 | Fed. Rep. of Germany | 8/21 C |
| 44-24712 | 10/1969 | Japan | 8/21 C |
| 7302648 | 9/1973 | Netherlands | 8/21 C |
| 1133650 | 11/1968 | United Kingdom . | |
| 1417512 | 12/1975 | United Kingdom . | |
| 1425451 | 2/1976 | United Kingdom | 8/174 |
| 513138 | 5/1976 | U.S.S.R. | 8/62 |

OTHER PUBLICATIONS

Mack, R., Canadian Textile Jour. Oct. 1970, pp. 107–112.

*Primary Examiner*—Joseph L. Schofer
*Assistant Examiner*—Maria S. Tungal
*Attorney, Agent, or Firm*—Curtis, Morris & Safford

[57] ABSTRACT

Fast colorations are obtained on materials consisting of or containing cellulosic fibers when aqueous alkaline solutions of water-insoluble dyeing matters are applied onto these materials, followed by a fixation by steaming and/or dry heat.

13 Claims, No Drawings

PROCESS FOR OBTAINING FAST COLORATIONS AND PRINTS ON MATERIALS CONSISTING OF CELLULOSIC FIBERS OR OF BLENDS THEREOF WITH SYNTHETIC FIBERS

It is generally known that difficulties arise when blended materials of cellulose fibers and synthetic fibers are to be colored and especially to be printed less expensively without unfavorably affecting the textile character of the fibrous material.

As regards the dyeing matter, the use of those dyestuffs which may be applied onto both kinds of fibers, is most economical. German Patent No. 1,811,796 discloses a corresponding process, which, however, may involve difficulties in practice due to the great quantities of swelling agent necessarily employed in the printing pastes.

It has now been found that fast colorations and prints can be achieved on cellulose fiber materials, when aqueous alkaline solutions of water-insoluble dyeing matters are applied onto these materials, following by a fixation of the colorations by steaming and/or by dry heat. Suitably acid-yielding agents are added to the aqueous dyestuff solution, especially in a preferred embodiment of the process of the invention in which the cellulosic fiber material contains synthetic fibers. The added acid-yielding agents have a color-deepening effect especially on the synthetic fibers.

Suitable synthetic fibers are especially polyester fibers, in particular those made from polyethylene glycol terephthalate, or cellulose triacetate fibers.

Among suitable dyeing matters for the process of the invention there may be mentioned any water-insolubles dyes which are soluble in aqueous alkalis and stable to alkalis to such a degree that they permit to obtain reproducible colorations on fibrous materials. Thus, pigments, for examples azo pigments such as the azo compounds produced on the fabric in the form of developing dyes, or other water-insoluble dyeing matters, especially disperse dyestuffs may be used. The solubility in alkalis of these dyeing matters is generally due to the presence of phenolic or enolic hydroxy groups. For obtaining the aqueous alkaline solutions there are generally used sufficiently strong bases, for example alkali metal or alkaline earth metal hydroxides, alkali metal or alkaline earth metal salts of weak or intermediately strong inorganic or organic acids, or organic nitrogen bases. The alkalis are used in the amount required for ensuring a solution, since an excess does not bring about any advantages, but is even disadvantageous, when an acid-yielding agent is used additionally, in which case corresponding high quantities of acid-yielding agent would be required and undesired salts would be formed.

For improving the solubility in alkalis from 1 to 100 g/l or g/kg of an organic solvent or solubilizer miscible with water may be added to the compositions of dyeing matter.

The quantity of the acid-yielding agent depends on the number of the groups effecting the solubility in alkalis and, consequently, on the molar weight of the dyeing matter. Generally about 10 to 200 g of acid-yielding agent are used for 1 liter or for 1 kg of dye preparation. Suitable acid-yielding agents are esters, optionally substituted amides or ureides of inorganic or organic acids or salts, especially alkali metal salts, of mono-halogenated low molecular weight carboxylic acids, especially lower alkanoic acids.

When the process according to the invention is carried out as pad-dyeing process or as printing process, there are used as thickeners for the dye compositions the usual thickeners resistant to alkalis, preferably etherified locust bean flour derivatives.

The colorations or prints are fixed in known manner by steaming and/or by dry heat. Especially in the case of pad-dyeings and prints, fixation is carried out by a treatment for a period of from 1 to 15 minutes in saturated steam or in superheated steam of a temeprature of from 160° to 190° C. and/or by a dry heat treatment, especially a hot air fixation for a period of from 20 to 90 seconds at a temperature of from 170° to 210° C.

The fixed colorations are after treated in known manner, for example for a period of from 1 to 15 minutes at a temperature of from 60° to 95° C. with anionic or non-ionic washing agents.

The dyeing matters applied onto the fabric in the form of a alkaline solution surprisingly reprecipitate on the fibrous material during the fixation operation and are anchored therein by agglomeration in such a way that the colorations are prints obtained easily withstand usual home laundering. In the case of blended fabrics, the action of the acid-yielding agent ensures that the dyeing matter, especially in the case of disperse dyes, can readily penetrate into the synthetic fibers, especially the polyester fiber, without changing so that a uniform coloration which practically has the same shade results on both kinds of fibers.

The following examples illustrate the invention. Percentages are by weight.

EXAMPLE 1

A cotton cretonne is printed with a printing paste of the following composition:

80 g of the commercial liquid preparation of the dyestuff of the formula

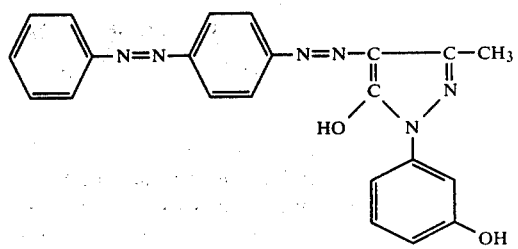

are dissolved in 20 g of 32.5% sodium hydroxide solutions and 200 g of luke-warm water. The solution is introduced while stirring into 500 g of an 8% aqueous solution of a locust bean flour carboxymethyl ether as thickener. Thereafter the paste is made up with water or with said thickener to 1000 g.

The printed and dried fabric is steamed for 5 minutes at 102° C. in saturated steam, subsequently thoroughly rinsed, treated for 10 minutes at 95° C. with 1 g/l of a 30-fold oxethylated nonylphenol, again rinsed and dried.

A golden-yellow print having good fastness properties is obtained.

EXAMPLE 2

A blended fabric consisting of 65% of polyethylene glycol terephthalate fibers and 35% of cotton is printed with a printing paste of the following composition: 60 g of the commercial liquid form of the dyestuff of the formula

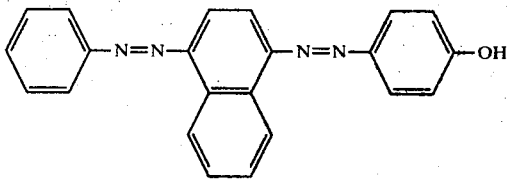

are dissolved in
50 g of triethanolamine and
200 g of water. The solution is introduced while stirring into
500 g of a 6% aqueous solution of a cellulose carboxymethyl ether as thickener. Thereafter there are added
80 g of acetyl urea as acid-yielding agent and the paste is subsequently made up to
1000 g with
110 g of water or of said thickener.

The printed and dried fabric is steamed for 6 minutes at 180° C. in superheated steam and subsequently treated as in Example 1.

An orange-colored print having good fastness properties is obtained.

EXAMPLE 3

A knitted fabric consisting of 50% of polyethylene glycol therephthalate fibers and 50% of cotton is printed with a printing paste of the following composition:

70 g of the commercial liquid form of the dyestuff of the formula

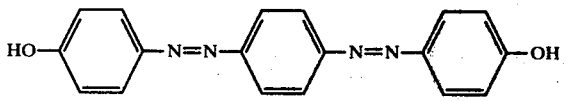

are dissolved in
50 g of piperidine and
200 g of water. This solution is introduced into
500 g of an 8% aqueous solution of a decomposed guar flour product as thickener. Thereafter there are added
80 g of acetyl urea as acid-yielding agent and the paste is made up to
1000 g with
100 g of water or of said thickener.

The printed and dried fabric is steamed for 5 minutes in saturated steam and thereafter thermosoled for 60 seconds at 200° C. Subsequently, the fabric is aftertreated as in Example 1.

A reddish-yellow print having good fastness properties is obtained.

EXAMPLE 4

A fabric of 65% of polyethylene glycol terephthalate fibers and 35% of highly water-resistant regenerated cellulose fibers ((R)Modal-fibers) is padded with a padding liquor of the following composition:

60 g of the pulverulent dyestuff of the formula

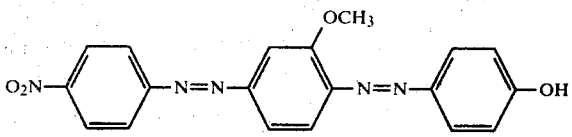

are dissolved in
20 g of 32.5% sodium hydroxide solution and
200 g of water. The resulting solution is thickened with
200 g of a 6% aqueous solution of an anion-active locust bean flour ether,
60 g of oxamide are added as acid-yielding agent and the liquor is made up with water to
1 l.

The padded fabric is steamed for 5 minutes in saturated steam and subsequently aftertreated with hot air for 60 seconds at 210° C. Thereafter the fabric is treated as in Example 1.

A brown coloration having good fastness properties is obtained.

EXAMPLE 5

A fabric of 70% of polycyclohexanedial terephthalate fibers and 30% of regenerated cellulose fibers is printed with a printing paste of the following composition:

80 g of the commercial liquid form of the dyestuff of the formula

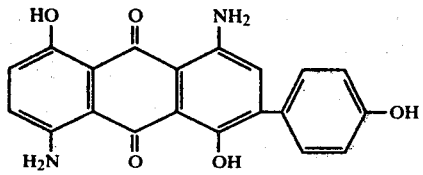

are dissolved in
100 g of triethanol amine and
200 g of water. The resulting solution is introduced into
500 g of a 6% aqueous solution of a locust bean flour carboxymethyl ether as thickener.
100 g of sodium β-chloropropionate are added as acid-yielding agent.

Thereafter the paste is made up to
1000 g with
20 g of water or of said thickener.

The printed and dried fabric is steamed for 8 minutes at 180° C. is superheated steam and after treated subsequently as described in Example 1.

A level blue print having good fastness properties is obtained.

I claim:

1. A process for coloring material comprised of cellulosic fibers which consists essentially of contacting said material with an aqueous alkaline solution of a water-insoluble alkali-soluble dye selected from the group consisting of pigments and disperse dyestuffs for a time sufficient to penetrate, for dyeing purposes, said material, followed by fixation by steaming, dry heat or a combination of steaming and dry heat, to reprecipitate, in a reproducible manner, said dye, and following said fixation, washing said fibers with an aqueous washing liquor containing anionic or non-ionic detergent.

2. A process as claimed in claim 1, wherein the material comprises 30 to 70% by weight of cellulosic fibers, balance synthetic fibers.

3. A process as claimed in claim 2, wherein the material comprises synthetic fibers of polyester.

4. A process as claimed in claim 2, wherein an aqueous alkaline solution has added thereto an acid-yielding agent, yielding said acid during fixation.

5. A process as claimed in claim 4, wherein the acid-yielding agent is an ester, an amide or ureide of an inorganic or organic acid, or a salt of a halogenated lower alkanoic acid.

6. A process as claimed in claim 1, wherein the cellulosic fibers are natural or regenerated cellulose.

7. A process as claimed in claim 1, wherein the base for the aqueous alkaline solution is an alkali metal hydroxide, an alkaline earth metal hydroxide, an alkaline-reacting alkali metal or alkaline earth metal salt of a weak or intermediately strong organic or inorganic acid, or an amine.

8. A process as claimed in claim 1, wherein the water-insoluble dye is a disperse dye.

9. A process as claimed in claim 1, wherein the aqueous alkaline solution contains a water-miscible organic solvent.

10. A process as claimed in claim 1, wherein the alkaline aqueous solution contains a thickener and is applied by padding, slop-padding or printing.

11. A process as claimed in claim 1, wherein fixation occurs by steaming for 1 to 15 minutes with saturated or superheated steam at 160° to 190° C.

12. A process as claimed in claim 1, wherein fixation occurs by a hot air treatment for 20 to 90 seconds at 170° to 210° C.

13. A process for coloring a fabric containing at least 30% by weight of cellulosic fibers which comprises padding, slop-padding or printing said fabric with an aqueous alkaline solution of a disperse dyestuff, soluble in said alkaline solution, said solution containing an alkali-stable thickener and an acid yielding agent, thereafter fixing by a heat treatment by steaming with saturated steam, steaming with super-heated steam or dry heat, whereby said acid-yielding agent sets free the acid, followed by washing with an aqueous washing liquor containing an anionic or nonionic detergent at 60° to 90° C.

* * * * *